United States Patent [19]

Stover

[11] Patent Number: 4,878,531

[45] Date of Patent: Nov. 7, 1989

[54] WALL COVERING SUPPORT STRUCTURE AND METHOD

[76] Inventor: Douglas F. Stover, P.O. Box 5803, Athens, Ohio 45701

[21] Appl. No.: 147,853

[22] Filed: Jan. 25, 1988

[51] Int. Cl.[4] ..... A47H 23/00

[52] U.S. Cl. ..... 160/327; 160/348; 160/404; 160/405

[58] Field of Search ..... 160/327, 328, 354, 368.1, 160/404, 348, 398, 399, 402, 405; 52/273, 735, 222

[56] References Cited

U.S. PATENT DOCUMENTS

| | | | |
|---|---|---|---|
| 2,297,729 | 10/1942 | Thomas | 160/354 X |
| 2,557,578 | 6/1951 | Stallone | 160/348 |
| 2,953,201 | 9/1960 | Richardson | 160/404 |
| 3,011,174 | 12/1961 | Schaerer | 160/348 |
| 3,185,207 | 5/1965 | Humble | 160/327 X |
| 3,683,994 | 8/1972 | Eichenlaub | 160/327 |
| 3,785,426 | 1/1974 | Sperling | 160/327 |
| 4,055,211 | 10/1977 | Sperling | 160/327 |
| 4,058,946 | 11/1977 | Habrant | 52/273 |
| 4,342,356 | 8/1982 | Sickels et al. | 160/327 X |

*Primary Examiner*—Ramon S. Britts
*Assistant Examiner*—David M. Purol
*Attorney, Agent, or Firm*—Jacox & Meckstroth

[57] ABSTRACT

Structure and a method for applying cover material to a wall. A support strip is attached to the upper portion of a wall, and a support strip is attached to the lower portion of the wall. Each of the support strips is substantially flat and includes spaced-apart pointed protuberances or projections. A sheet of flexible fabric material is stretched taut between the support strips and attached to the projections of the support strips. A cover strip is attached in covering relationship upon each support strip and covers the portion of the sheet of flexible fabric material which is attached to the support strip. As the sheet is attached to the support strips, spaced-apart folds are formed in the upper and lower portions of the sheet and create the appearance of pleats in the sheet. Thus, an attractive wall covering is provided.

13 Claims, 1 Drawing Sheet

WALL COVERING SUPPORT STRUCTURE AND METHOD

BACKGROUND OF THE INVENTION

For aethetic and acoustical purposes numerous types of walls are covered with a flexible fabric material, such as cloth, burlap, and the like. It is desirable that the flexible fabric material be formed to have the appearance of pleats.

Numerous types of structures have been created for the purpose of attaching a flexible fabric material to a wall for covering the wall. U.S. Pat. Nos. 2,212,055, 2,242,355, 2,524,958, 2,557,578, 3,185,207 3,300,827, 3,304,995, 3,338,292, 3,683,994, 3,785,426, 3,822,734 and 4,342,356 show various types of structures and wall covering systems.

However, several problems have occurred with regard to such wall covering structures and systems. One of the problems pertains to costs of production and installation. Another problem pertains to the space required for the support structure.

It is an object of this invention to provide a wall covering support structure and method which minimizes the costs of production and installation of wall coverings and support structures.

It is another object of this invention to provide such a wall covering structure and method by which an attractive pleated appearance is created in the wall covering material.

It is another object of this invention to provide such a wall covering support structure and method by which wall covering material is attached to a wall and pleats are created in the wall covering material.

Another object of this invention is to provide wall covering support structure by which the support structure and the wall covering material is closely adjacent the wall which is covered.

It is another object of this invention to provide such a wall covering support structure and method for use in a hall or room through which the public travels, but which provides minimum opportunity for tampering with the wall covering material or support structure and provides minimum opportunity for vandalism with the wall covering support structure and wall covering material.

Other objects and advantages of this invention reside in the construction of parts, the combination thereof, the method of production, method of installation, and the mode of use, as will become more apparent from the following description.

SUMMARY OF THE INVENTION

This invention comprises support structure and a method for attaching flexible wall covering material to a wall so that the flexible wall covering material has the appearance of pleats. The support structure includes an elongate support strip of relatively rigid material, such as metallic material, or plastics material, or the like. The support strip of relatively rigid material includes pointed protuberances or projections. In one embodiment of the invention the pointed protuberances or projections extend from a longitudinal edge of the support strip. In another embodiment of the invention the pointed protuberances or projections extend from positions between the longitudinal edges of the support strip.

For support of the flexible wall covering material two elongate support strips are used. One relatively rigid support strip is attached to the upper portion of a wall and extends along the upper portion of the wall. The upper support strip is oriented so that the pointed projections thereof extend upwardly. Another relatively rigid support strip is attached to a lower portion of the wall and extends along the wall. The lower support strip is oriented so that the pointed projections thereof extend downwardly. A sheet of flexible fabric material, such as cloth or burlap or the like, is attached to the pointed protuberances or projections of the support strip at the upper portion of the wall, and then the sheet of flexible fabric material is stretched downwardly and is attached to the pointed protuberances of the support strip at the lower portion of the wall. As the sheet of flexible fabric material is attached to the pointed protuberances of the upper and lower support strips, vertically extending portions of the sheet of flexible fabric material are folded. Thus, as the sheet of flexible fabric material is attached to the wall the sheet assumes the appearance of a sheet of pleated material.

DETAILED DESCRIPTION OF THE PREFERRED EMBODIMENTS

Figure 1:
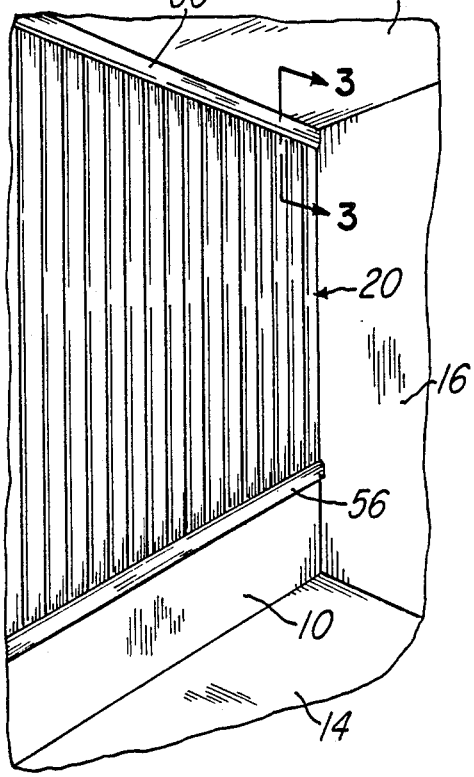
FIG. 1 is a perspective view showing wall covering structure of this invention.

FIG. 1 shows a wall 10, a ceiling 12, a floor 14, and an adjoining wall 16. The major part of the wall 10 covered by a flexible sheet 20 in accordance with this invention.

Figure 2:
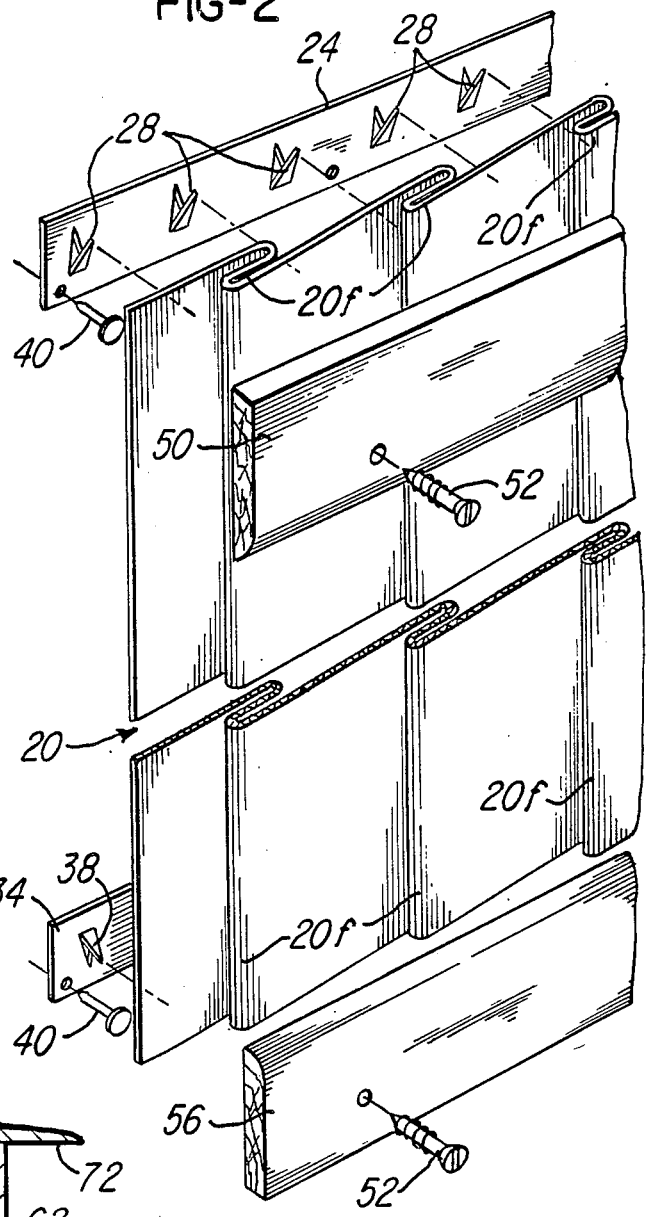
FIG. 2 is a greatly enlarged fragmentary perspective exploded view, with parts shown in section, illustrating a preferred embodiment of the wall covering structure and method of this invention.

As shown in FIG. 2, a relatively rigid support strip 24 is attached to the wall 10 and extends along the upper part of the wall 10. The support strip 24 is preferably, but not necessarily, of metallic material. The support strip 24 may be of plastics material or the like. The support strip 24 has spaced-apart upwardly extending pointed protuberances or projections 28, which are shown as being partially cut-out and bent-out portions of the support strip 24. A relatively rigid support strip 34, also shown in FIG. 2, similar to the support strip 24, is attached to the wall 10 and extends along a lower part of the wall 10. The support strip 34 has spaced-apart downwardly extending pointed protuberances or projections 38, which are shown as being partially cut-out and bent-out portions of the support strip 34.

As illustrated in FIG. 2, the support strips 24 and 34 may be attached to the wall 10 by means of nails 40.

Figure 3:
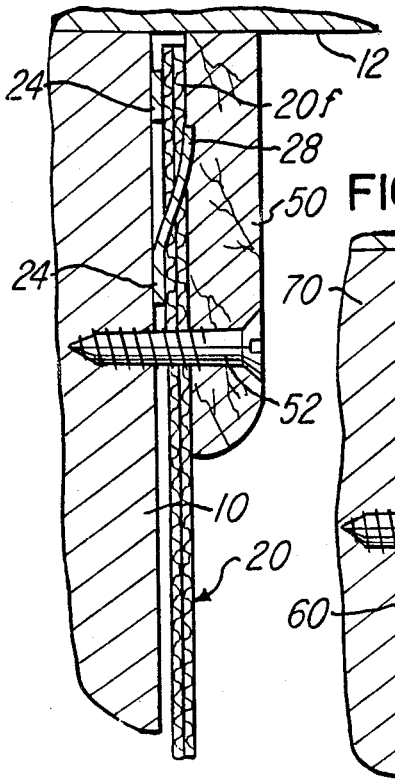
FIG. 3 is an enlarged fragmentary sectional view, drawn on a larger scale than FIG. 2, and taken substantially on line 3—3 of FIG. 1.

After the support strips 24 and 34 are attached to the wall 10, the sheet 20 of flexible fabric material, such as cloth or burlap or the like, is first attached to the strip 24, which extends along the upper portion of the wall 10. As the upper part of the sheet 20 is attached to the projections 28 of the support strip 24, spaced-apart portions of the sheet 20 are provided with folds 20*f*. The sheet 20 is attached to the pointed protuberances 28 along the entire length of the strip 24, as the upper part of the sheet 20 is hooked over and attached to the protuberances or projections 28 and as spaced-apart portions of the sheet 20 are provided with folds 20*f*. As illustrated in FIG. 3, the projections 28 extend through the sheet 20.

Then the lower portions of the sheet 20 are pulled slightly downwardly, as the sheet 20 is stretched between the upper support strip 24 and the lower support strip 34. Then the lower portions of the sheet 20 are attached to the downwardly extending pointed protuberances 38 of the support strip 34. Thus, the sheet 20 is taut between the support strips 24 and 34. As the sheet 20 is pulled taut and attached to the protuberances or projections 38 of the support strip 34, the lower portion of the sheet 20 is also provided with folds 20*f*. When the sheet 20 is drawn tightly between the strips 24 and 34, the folds 20*f* assume the appearance of pleats in the sheet 20. Thus, the sheet 20 has a very pleasing appearance as the sheet 20 covers the wall 10.

Then, as illustrated in FIGS. 2 and 3, a cover strip 50 is attached to the upper part of the sheet 20 and to the support strip 24 by means of screws 52 or the like. The screws 52 extend through the sheet 20, and through the support strip 24 and into the wall 10, as illustrated in FIG. 3. The screws 52 are drawn tightly and force the cover strip 50 against the sheet 20, as shown in FIG. 3. The cover strip 50 also forces the protuberances 28 toward the wall 10 and into firm engagement with the upper portion of the sheet 20, as shown in FIG. 3. Thus, the upper portion of the sheet 20 is firmly secured to the support strip 24 and to the wall 10.

Similarly, a cover strip 56 is attached by screws 52 to the lower portion of the sheet 20 and to the support strip 34, as illustrated in FIG. 2. The screws 52 extend through the cover strip 56, through the lower portion of the sheet 20, and through the support strip 34, and into the wall 10. The screws 52 force the cover strip 56 tightly against the sheet 20 and force the protuberances 38 toward the wall 10 and into firm engagement with the lower portion of the sheet 20. Thus, the lower portion of the sheet 20 is firmly secured to the support strip 34 and to the wall 10.

It is to be noted that the cover strips 50 and 56 are relatively thin, and as the cover strips 50 and 56 are in juxtaposition with the wall 10, the cover strips 50 and 56 are very close to the wall 10. Therefore, the cover strips 50 and 56 do not project significantly from the wall 10, and the cover strips 50 and 56 do not create an obstruction to people who move adjacent the wall 10. Also, the strips 50 and 56 add to the attractive appearance of the sheet 20 as the sheet 20 covers the wall 10.

If desired, in a room or hall in which the ceiling 12 is very high above the floor 14, it may not be necessary to have a cover strip 50 covering the upper support strip 24 and the upper portion of the sheet 20, due to the fact that the support strip 24 may not be readily observable by a person standing on the floor 14.

Figure 5:
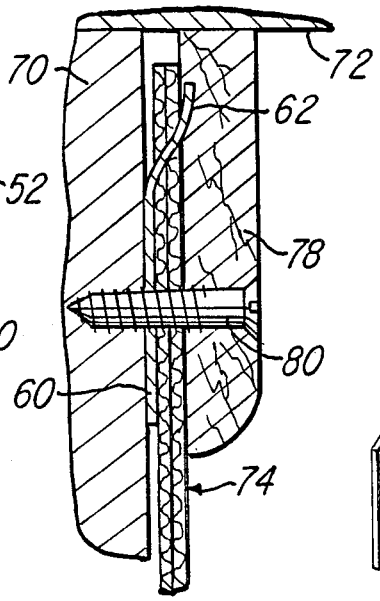
FIG. 5 is a sectional view, similar to FIG. 3, and drawn on substantially the same scale as FIG. 3, showing installation which includes the support strip of FIG. 4.
Figure 4:
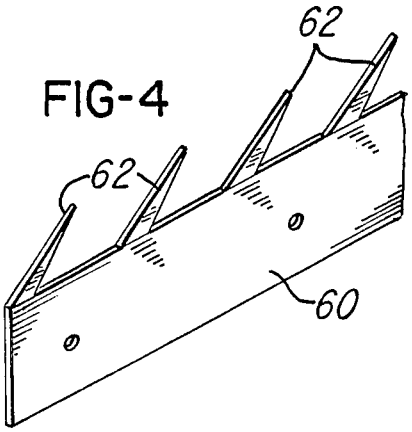
FIG. 4 is a perspective view drawn on substantially the same scale as FIG. 3, illustrating another embodiment of a support strip of the structure of this invention.

FIGS. 4 and 5

FIGS. 4 and 5 illustrate another embodiment of the wall covering structure and method of this invention.

An elongate support strip 60 has pointed protuberances or projections 62 extending from a longitudinal edge thereof. One support strip 60 is attached to the upper portion of a wall 70, in the manner illustrated and discussed with regard to the support strip 24. A ceiling 72 is shown above the wall 70 in FIG. 5. When the support strip 60 is attached to the upper portion of the wall 10, the support strip 60 is oriented with the projections 62 extending upwardly. Another support strip 60, not shown, is attached to the lower portion of the wall 70. When the support strip 60 is attached to the lower portion of a wall 70, the support strip 60 is oriented with the protuberances or projections 62 extending downwardly.

FIG. 5 illustrates the manner in which the support strip 60 is attached to an upper portion of the wall 70. A sheet 74 of flexible fabric material, similar to the sheet 20, is attached to the protuberances 62 of the support strip 60 which is attached to the upper portion of the wall 70. Then, the sheet 74 of fabric material is stretched downwardly and attached to a support strip 60 at the lower portion of the wall 70.

Then, as shown in FIG. 5, a cover strip 78 is attached to the upper portion of the wall 70 by means of screws 80 which extend through the sheet 74 of fabric material, through the support strip 60 and into the wall 70. As shown, the cover strip 78 forces the protuberances 62 firmly against the sheet 74 of fabric material. Thus, the sheet 74 is firmly retained upon the upper portion of the wall 70. Another cover strip 78 is attached to the lower portion of the wall 70, in covering relationship to the support strip 60 at the lower portion of the wall 70. The cover strip 78 forces the protuberances 62 against the sheet 74. Therefore, the sheet 74 is firmly attached to the lower portion of the wall 70.

Thus, in summary, it is to be understood that support strips 24, 34, and 60 are employed to attach a sheet of flexible fabric material, such as the sheet 20 or the sheet 74, to a wall, such as the wall 10 or the wall 70. The sheet is stretched taut between an upper support strip and a lower support strip. The sheet is provided with spaced-apart folds, which create in the sheet the appearance of pleats. Thus, the sheet provides an attractive wall coverings.

It is to be understood that the elongate support strips of this invention do not need to be horizontal or substantially horizontal. Support strips of this invention may be oriented at any desired angle. Support strips of this invention may be vertically oriented and attached to opposed spaced-apart vertical portions of a wall. A sheet of fabric material is attached to the vertically extending support strips, and the sheet extends between the vertically oriented support strips. In such orientation of the support strips, folds in the sheet extend horizontally between the vertical support strips.

Although the preferred embodiments of the wall covering structure and method of this invention have been described, it will be understood that within the purview of this invention various changes may be made in the form, details, proportion and arrangement of parts, the combination thereof, and the mode of installation and use, which generally stated consist in a structure and/or method within the scope of the appended claims.

The invention having thus been described, the following is claimed:

1. Wall covering structure for covering a wall, the wall having an upper portion and a lower portion, comprising: a first elongate flat support strip, the first elongate flat support strip having a pair of opposed longitudinally extending peripheral edges, the first elongate flat support strip having a flat surface extending along the length thereof and between the opposed longitudinally extending peripheral edges thereof, a series of spaced-apart protuberances integral with the first elongate flat support strip and extending outwardly therefrom thereof, the first elongate flat support strip being adapted to be positioned horizontally and attached to the upper portion of a wall with the protuberances extending upwardly from the first elongate flat support strip, a second elongate flat support strip, the second elongate flat support strip having a pair of opposed longitudinally extending peripheral edges, the second elongate flat support strip having a flat surface extending along the length thereof and between the opposed longitudinally extending peripheral edges thereof, a series of spaced-apart protuberances integral with the second elongate flat support strip and extending outwardly therefrom, the second elongate flat support strip being adapted to be positioned horizontally and attached to the lower portion of a wall below the first elongate flat support strip and with the protuberances extending downwardly from the second elongate flat support strip, a sheet of flexible cloth-like material having an upper portion and a lower portion, there being a series of vertical fold sections which extend between the upper portion of the sheet and the lower portion of the sheet, the sheet of flexible cloth-like material being adapted to be attached to the elongate flat support strips, the upper portion of the sheet being attached to and supported by the first elongate flat support strip with the protuberances of the first elongate flat support strip extending through the vertical fold sections at the upper portion of the sheet of cloth-like material, the lower portion of the sheet of cloth-like material being attached to and supported by the second elongate flat support strip with the protuberances of the second elongate support strip extending through the vertical fold sections at the lower portion of the sheet of cloth-like material, the sheet of cloth-like material thus covering a wall.

2. The wall covering structure of claim 1 which includes cover means covering at least one of the elongate flat support strips and adapted to cover the portion of the sheet which is adapted to be attached to said one of the support strips.

3. The wall covering structure of claim 1 and in which the protuberances of the first elongate flat support strip extend upwardly from a position between the pair of longitudinally extending peripheral edges.

4. The wall covering structure of claim 1 which includes a first elongate flat cover strip and a second elongate flat cover strip, the first elongate flat cover strip being adapted to be positioned horizontally and attached to the first elongate flat support strip in juxtaposition with the first elongate flat support strip and in covering relationship thereto, the first elongate flat cover strip also covering the upper portion of the sheet, the first elongate flat cover strip also covering the protuberances of the first elongate flat support strip, the first elongate flat cover strip being in engagement with the protuberances of the first elongate flat support strip and urging the protuberances and the upper portion of the sheet toward the flat surface of the first elongate flat support strip, the second elongate flat cover strip being adapted to be positioned horizontally and attached to the second elongate flat support strip in juxtaposition with the second elongate flat support strip and in covering relationship thereto, the second elongate flat cover strip also covering the lower portion of the sheet, the second elongate flat cover strip also covering the protuberances of the second elongate flat support strip, the second elongate flat cover strip being in engagement with the protuberances of the second elongate flat support strip and urging the protuberances and the lower portion of the sheet toward the flat surface of the second elongate flat support strip.

5. The wall covering structure of claim 1 in which the protuberances of the first elongate flat support strip extend upwardly from one of the longitudinally extending peripheral edges.

6. The method of covering a wall which has an upper portion and a lower portion, comprising: forming a first elongate flat support strip in which the first elongate flat support strip has a pair of opposed end portions and in which the elongate flat support strip has a first peripheral edge and a second peripheral edge which extend along the length of the first elongate flat support strip, and in which the first elongate flat support strip has a flat surface which is entirely flat between the first and second peripheral edges thereof and between the end portions thereof, forming a series of projections which extend from the flat surface of the first elongate flat support strip, positioning the first elongate flat support strip horizontally and attaching the first elongate flat support strip to the upper portion of the wall with the projections of the first elongate flat support strip extending upwardly from the flat surface thereof, forming a second elongate flat support strip in which the second elongate flat support strip has a pair of opposed end portions and in which the elongate flat strip has a first peripheral edge and a second peripheral edge which extend along the length of the second elongate flat support strip, and in which the second elongate flat support strip has a flat surface which is entirely flat between the first and second peripheral edges thereof and between the end portions thereof, forming a series of projections which extend from the flat surface of the second elongate flat support strip, positioning the second elongate flat support strip horizontally and attaching the second elongate flat support strip to the lower portion of the wall with the projections of the second elongate flat support strip extending downwardly from the flat surface thereof, providing a sheet of flexible cloth-like material in which the flexible sheet has an upper portion and a lower portion, attaching the upper portion of the sheet of flexible cloth-like material to the projections of the first elongate flat support strip which is attached to the upper portion of the wall, stretching the sheet by pulling the lower portion of the sheet downwardly and attaching the lower portion of the sheet to the projections of the second elongate flat support strip at the lower portion of the wall.

7. The method of claim 6 which includes forming spaced-apart vertically extending fold sections in the sheet of flexible cloth-like material with the fold sections extending between the upper portion of the sheet and the lower portion of the sheet, attaching the fold sections which are at the upper portion of the shell to the first elongate flat support strip which is at the upper portion of the wall and attaching the fold sections which are at the lower portion of the sheet to the second elongate flat support strip which is at the lower portion of the wall.

8. The method of claim 6 which includes attaching a flat cover strip to at least one of the elongate flat support strips in close juxtaposition therewith and in juxtaposition with the wall for closely covering said one of the elongate flat support strips and the portion of the sheet which is attached to said one of the elongate flat support strips.

9. The method of claim 6 which includes providing a pair of elongate flat cover members, there being a first elongate flat cover member and a second elongate flat cover member, placing the first elongate flat cover member over the first elongate flat support strip and over the portion of the sheet which is attached to the first elongate flat support strip, followed by attaching the first elongate flat cover member to the first elongate flat support strip, placing the second elongate flat cover member over the second elongate flat support strip and over the portion of the sheet which is attached to the second elongate flat support strip, followed by attaching the second elongate flat cover member to the second elongate flat support strip, whereby the upper portion of the sheet and the lower portion of the sheet are sandwiched between the wall and the elongate flat support strips and whereby the sheet is secured in position with respect to the wall.

10. The method of claim 6 which includes covering each of the elongate flat support strips with an elongate flat cover member, followed by forcing each elongate flat cover member against the projections of its respective elongate flat support strip and forcing the projections thereof toward the wall, followed by attaching each of the elongate flat cover members to its respective elongate flat support strip for securing the sheet with respect to the elongate support strips and with respect to the wall.

11. In combination with a wall having an upper portion and a lower portion, wall covering structure comprising a first elongate flat support strip, the first elongate flat support strip having an upper peripheral edge and a lower peripheral edge which extend along the length of the first elongate flat support strip, the first elongate flat support strip having a rear surface which is flat along the entire length of the first elongate flat support strip and which is flat between the upper peripheral edge of the first elongate flat support strip and the lower peripheral edge thereof, the first elongate flat support strip having a front surface which is flat between the lower peripheral edge thereof and the upper peripheral edge thereof, the first elongate flat support strip including a series of projections, each of the projections extending from the front surface of the first elongate flat support strip, the first elongate flat support strip being oriented horizontally and attached to the upper portion of the wall with the entire rear surface of the first elongate flat support strip in engagement with the upper portion of the wall and with the projections of the first elongate flat support strip extending upwardly, a second elongate flat support strip, the second elongate flat support strip having an upper peripheral edge and a lower peripheral edge, the second elongate flat support strip having a rear surface which is flat along the entire length of the second elongate flat support strip and which is flat between the upper peripheral edge thereof and the lower peripheral edge thereof, the second elongate flat support strip having a front surface which is flat between the lower peripheral edge thereof and the upper peripheral edge thereof, the second elongate flat support strip including a series of projections, each of the projections extending from the front surface of the second elongate flat support strip, the second elongate flat support strip being oriented horizontally and attached to the lower portion of the wall with the entire rear surface of the second elongate flat support strip in engagement with the lower portion of the wall and with the projections of the second elongate flat support strip extending downwardly, a flexible sheet of cloth-like material having an upper portion and a lower portion, the flexible sheet having spaced-apart fold sections which extend between the upper portion of the sheet and the lower portion of the sheet, the upper portion of the sheet being in engagement with the front surface of the first elongate flat support strip with the projections of the first elongate flat support strip extending through the fold sections which are at the upper portion of the flexible sheet, the lower portion of the flexible sheet being in engagement with the front surface of the second elongate flat support strip with the projections of the second elongate flat support strip extending through the fold sections which are at the lower portion of the flexible sheet, the flexible sheet of cloth-like material thus extending between the first elongate flat support strip and the second elongate flat support strip and covering the wall.

12. The combination of claim 11 which includes at least one elongate flat cover member, each elongate flat cover member being in close covering relationship to one of the elongate flat support strips along the length thereof and attached thereto parallel therewith, each elongate flat cover member covering the portion of the flexible sheet which is attached to the elongate flat support strip to which the elongate flat cover member is attached, whereby each elongate flat support strip which is covered by an elongate flat cover member and the projections thereof and the portion of the flexible sheet which is attached thereto are sandwiched between the wall and the elongate flat cover strip.

13. The combination of claim 11 which includes a pair of elongate flat cover members, there being an upper elongate flat cover member in close covering relationship to the first elongate flat support strip along the length thereof and attached thereto parallel therewith, the first elongate flat cover member covering the portion of the upper portion of the upper flexible sheet which is attached to the first elongate flat support strip, whereby the first elongate flat support strip and the projections thereof and the portion of the flexible sheet which is attached thereto are sandwiched between the wall and the first elongate flat cover member, there being a lower elongate flat cover member in close covering relationship to the second elongate flat support strip along the length thereof and attached thereto parallel therewith, the second elongate flat cover member covering the portion of the lower portion of the upper flexible sheet which is attached to the second elongate flat support strip, whereby the second elongate flat support strip and the projections thereof and the portion of the flexible sheet which is attached thereto are sandwiched between the wall and the second elongate flat cover strip.

* * * * *

UNITED STATES PATENT AND TRADEMARK OFFICE

CERTIFICATE OF CORRECTION

PATENT NO. : 4,878,531

DATED : November 7, 1989

INVENTOR(S) : Douglas F. Stover

It is certified that error appears in the above-identified patent and that said Letters Patent is hereby corrected as shown below:

Column 2, line 46, after "10" insert ---is---.

Column 4, line 44, change "coverings" to ---covering---.

Column 5, line 9, delete "thereof"; line 45, change "covering" to ---adapted to cover---; line 49, delete "and".

Signed and Sealed this

Twenty-third Day of October, 1990

*Attest:*

HARRY F. MANBECK, JR.

*Attesting Officer*

*Commissioner of Patents and Trademarks*